US008408543B2

(12) United States Patent
Razzaboni et al.

(10) Patent No.: US 8,408,543 B2
(45) Date of Patent: Apr. 2, 2013

(54) BANKNOTE STORAGE UNIT

(75) Inventors: Nicoletta Razzaboni, Mirandola (IT); Vittorio Razzaboni, Mirandola (IT)

(73) Assignee: CIMA S.p.A. di Razzaboni & C., Mirandola (Modena) (IT)

( * ) Notice: Subject to any disclaimer, the term of this patent is extended or adjusted under 35 U.S.C. 154(b) by 53 days.

(21) Appl. No.: 13/058,057

(22) PCT Filed: Aug. 5, 2009

(86) PCT No.: PCT/IB2009/006496

§ 371 (c)(1),
(2), (4) Date: Mar. 23, 2011

(87) PCT Pub. No.: WO2010/015926

PCT Pub. Date: Feb. 11, 2010

(65) Prior Publication Data

US 2011/0168734 A1 Jul. 14, 2011

(30) Foreign Application Priority Data

Aug. 8, 2008 (IT) ..... MI2008A1511

(51) Int. Cl.
*B65H 5/02* (2006.01)

(52) U.S. Cl. ..... 271/275; 242/528

(58) Field of Classification Search ..... 271/275, 271/277; 242/528
See application file for complete search history.

(56) References Cited

U.S. PATENT DOCUMENTS

| | | | | |
|---|---|---|---|---|
| 4,373,712 | A | 2/1983 | Mitzel | |
| 5,100,125 | A * | 3/1992 | Uplinger et al. | 271/233 |
| 6,186,339 | B1 | 2/2001 | Saltsov | |
| 2003/0000957 | A1 | 1/2003 | Brexel | |
| 2007/0221776 | A1 * | 9/2007 | Rossel et al. | 242/528 |

FOREIGN PATENT DOCUMENTS

| | | |
|---|---|---|
| EP | 0 652 176 | 5/1995 |
| GB | 2 124 005 | 2/1984 |
| WO | 01/25127 | 4/2001 |

* cited by examiner

*Primary Examiner* — Michael McCullough
(74) *Attorney, Agent, or Firm* — Jacobson Holman PLLC

(57) ABSTRACT

A banknote store includes a banknote storage roller, two banknote conveyor belts and two collection sprockets of said belts, each belt being wound on one side to the storage roller and on the other to one of the collection sprockets, the two belts being arranged to come into contact with the banknotes respectively on opposite faces, a handling device being present to move the roller, the sprockets and the belts so as to alternatively realize the storage of the banknotes on the roller or their release from the store. The collection sprockets are mounted on a same shaft.

13 Claims, 4 Drawing Sheets

BANKNOTE STORAGE UNIT

This is a national stage of PCT/IB09/006496 filed Aug. 5, 2009 and published in English, which claims the priority of Italian number MI2008A001511 filed Aug. 8, 2008, hereby incorporated by reference.

The present invention refers to an innovative banknote store.

It is known in the field to make banknote stores comprising a storage roller, two banknote conveyor belts and two collection sprockets of the belts.

The belts, made from a plastic film, are wound on one side to the storage roller and on the other on the respective collection sprocket.

The conveyor belts in use come into contact with the banknotes on opposite faces so as to transport them from an entrance/exit of the store to the storage roller, and vice versa.

The store also comprises one or more motors suitable for rotating the sprockets, the storage roller and the belts so as to store or release the banknotes.

According to the prior art, the sprockets are arranged on the same plane on different rotation shafts, with offset axes. Moreover, the motors for moving the roller and sprockets are arranged at the rear of the store, which implies a substantial bulk of the store in a direction parallel to the axis of the sprockets and of the roller.

A further problem relative to this type of store is that of constantly maintaining a correct tension of the belt, in both the storage step and the banknote release step.

The general purpose of the present invention is to avoid the aforementioned drawbacks by making a banknote store having limited bulk.

A further purpose of the invention is to provide a store which allows a correct tension of the banknote conveyor belts to be maintained in every operation condition.

Another purpose of the invention is that of providing a cost-effective banknote store with a simple structure, and which only requires a limited amount of components to operate.

A further purpose of the invention is to provide a store having a high banknote storage capacity.

In view of such a purpose it has been thought to make, according to the invention, a banknote store comprising a banknote storage roller, two banknote conveyor belts and two collection sprockets of said belts, each belt being wound on one side to the storage roller and on the other to one of the collection sprockets, the two belts being arranged to come into contact with the banknotes respectively on opposite faces, handling means being present to move the roller, the sprockets and the belts so as to alternatively realize the storage of the banknotes on the roller or their release from the store, characterized in that said collection sprockets are mounted on a same shaft.

In order to clarify the explanation of the innovative principles of the present invention together with its advantages with respect to the prior art, hereafter, with the help of the attached drawings, a possible example embodiment applying such principles shall be described.

Figure 1:
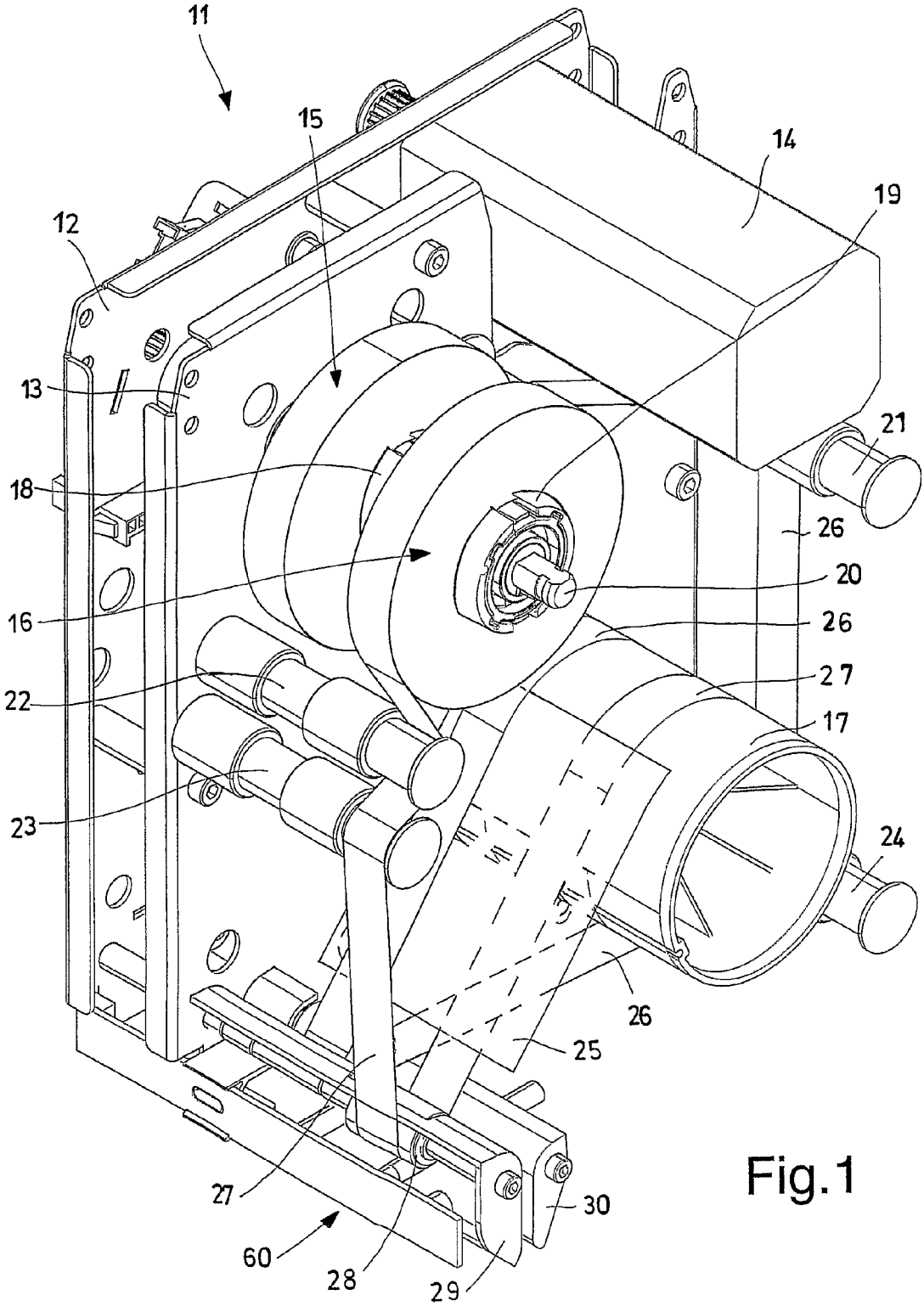
FIG. 1 represents a perspective view of the store on the side of the sprockets and of the storage roller.
Figure 2:
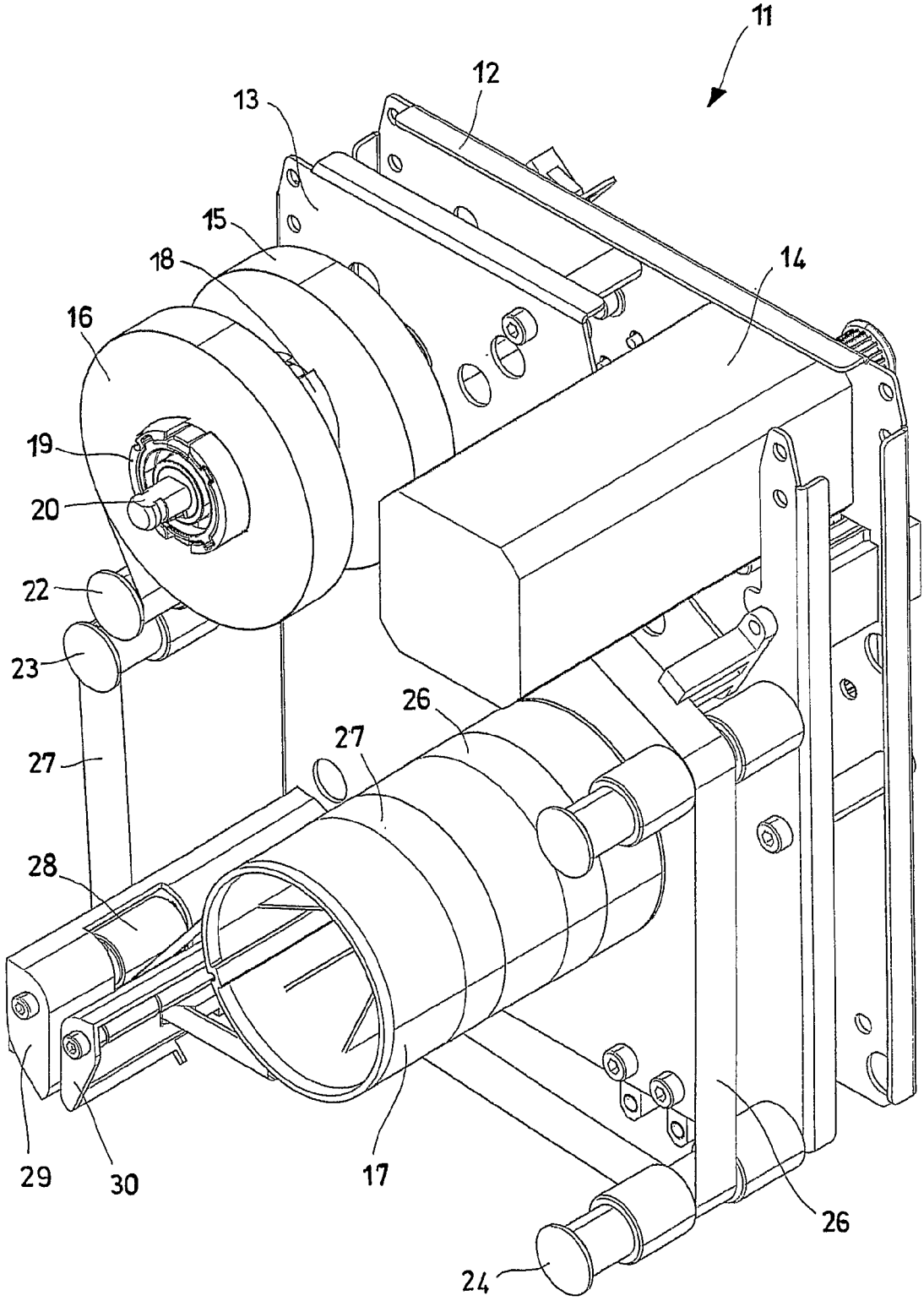
FIG. 2 represents a further perspective view of the store on the side of the sprockets and of the storage roller.

With reference to the figures, FIG. 1 shows a store 11 comprising a banknote storage roller 17, two banknote conveyor belts 26, 27 made from plastic film and two collection sprockets 18, 19 of the two belts 26, 27.

The store comprises a fixed frame comprising the two support plates 12 and 13 on which the sprockets 18, 19 and the roller 17 are mounted with the possibility of rotating around their axis.

The belts 26 and 27 are arranged so as to come into contact with the banknotes on opposite faces to convey them from an entrance/exit 60 of the store to the storage roller 17 and vice versa. FIG. 1 shows a banknote 25 with the belt 26 in contact with its upper face and the belt 27 in contact with the lower face.

The belt 26 is wound on one side to the roller 17 and on the opposite side to the sprocket 18 so as to be wound up forming a coil 15. Similarly, the belt 27 is wound on one side to the roller 17 and on the opposite side on the sprocket 19 to form a coil 16.

The store comprises return means of the belts 26, 27 suitable to form a banknote conveying course from the entrance/exit 60 to the roller 17 and vice versa. The return means respectively comprise the pulleys 61, 21, 24 and 28*a* (clearly shown in FIG. 5) for the belt 26, and the pulleys 22, 23 and 28 for the belt 27. The pulleys 28 and 28*a* are mounted at the bodies 29 and 30, which define a banknote entrance/exit slot into/from the store.

According to the invention, the sprockets 18 and 19 are coaxially mounted on a same shaft 20. This particular arrangement of the collection sprockets has a series of advantages compared to the prior art, especially in terms of bulk, as shall be further explained hereafter.

The courses of the belts 26 and 27 unwind on two distinct planes perpendicular to the axis of the sprockets 18, 19 and of the roller 17, so that the belts are wound offset and not mutually overlapped on the storage roller 17. This allows the bulk of the banknotes wound with the belts on the roller 17 to be substantially reduced compared to the solutions of the prior art, which would normally foresee the belts mutually overlapped. Moreover, this allows the stability of the belts and of the banknotes wound around the roller 17 to be improved, due to the greater friction which normally exists between belt and banknote compared to the friction between belt and belt.

The store 11 comprises motion means suitable to move the roller 17, the sprockets 18, 19 and the belts 26, 27 so as to alternatively carry out the storing of the banknotes on the roller 17 or their release from the store.

Advantageously, the motion means comprise a single motor 14 and motion transmission means from the motor to the shaft 20 of the sprockets 18, 19 and to the roller 17.

Figure 3:
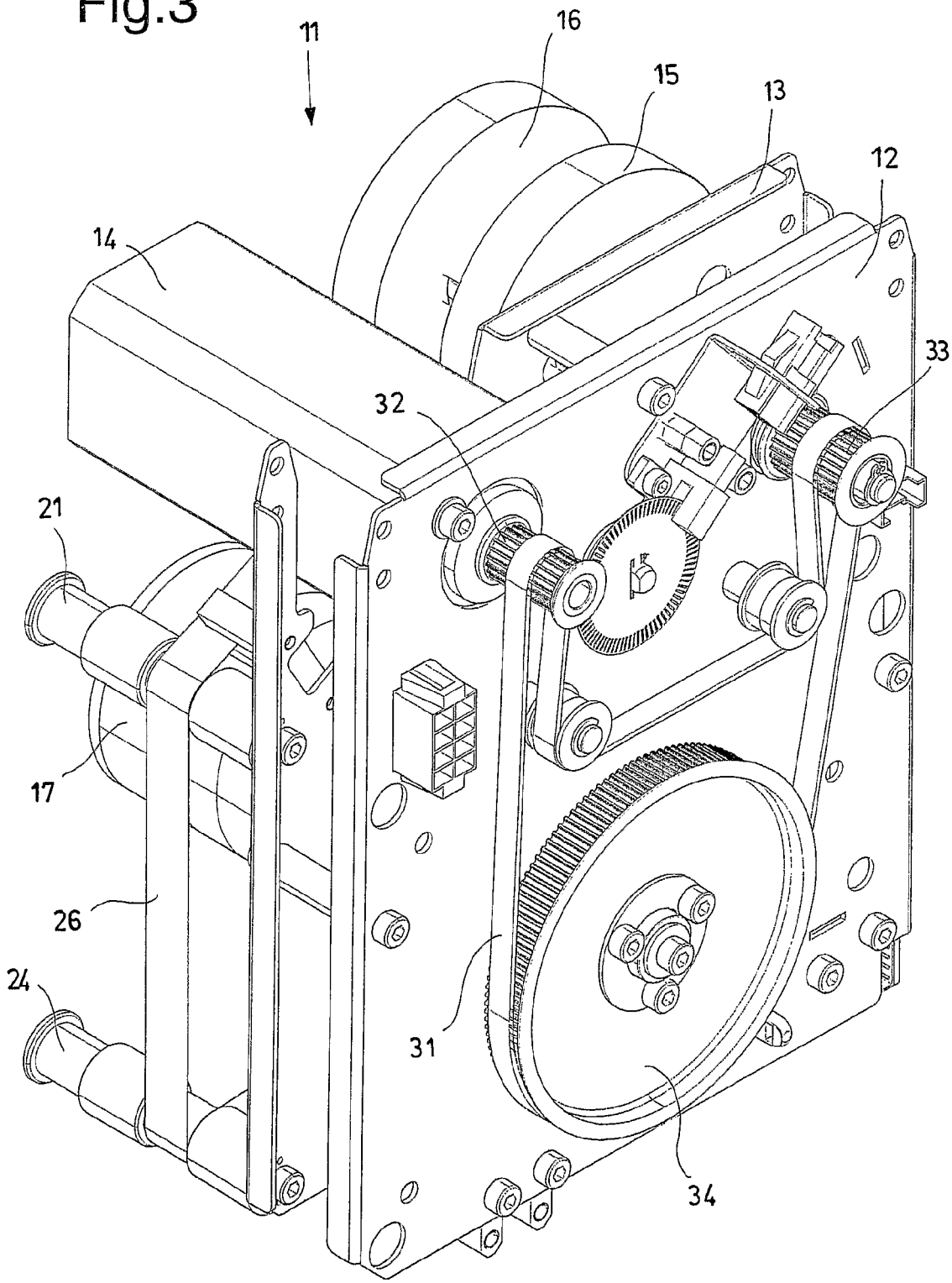
FIG. 3 represents a perspective view of the store on the side of the motion transmission means.

The motor 14 is mounted on the same side as the support plate 12 with respect to the sprockets 18, 19 and to the roller 17. The motion transmission means, on the other hand, are arranged on the opposite side of the plate 12, as shown in FIG. 3.

A pinion 32 is fixed with respect to the rotor of the motor 14 and transmits motion to the pinions 33 and 34 through a belt 31, suitably redirected as shown in the figures. The pinion 34 is advantageously fixed to the roller 17. The pinion 33, on the other hand, is connected to the shaft 20 of the sprockets through a free wheel, suitable for transmitting the rotation motion only in the winding direction of the belts 26, 27 on the respective sprockets (or rather, in the releasing step of the banknotes from the store).

The shaft 20 is mounted onto the frame 12, 13 of the store so as to be able to rotate only in the winding direction of the belts 26, 27 on the sprockets. In the opposite unwinding direction of the belts (i.e., the storage step of the banknotes on the roller 17), the shaft 20 is prevented from rotating.

The motion transmission is such as to induce a greater rotation speed of the shaft of the sprockets 18, 19 than that of the storage roller 17 during the unwinding step of the belt from the roller to control the releasing operations of the banknotes. For such a purpose, the diameter of the pinion 34 is suitably selected to be greater than the diameter of the pinion 33 associated with the sprockets 18, 19.

The sprockets 18, 19 are mounted on the shaft 20 through a respective joint suitable for limiting the torque transmitted between the shaft 20 and the sprocket. Advantageously, the joint is of the magnetic type, as clearly shown in FIG. 4 in section.

Such a figure shows the shaft 20, onto which the two sprockets 18 and 19 are mounted, intended to hold the belt coils 15 and 16 respectively.

Hereafter, only the first magnetic joint which operates between the sprocket 18 and the shaft 20 shall be described, since the second joint arranged between the shaft 20 and the sprocket 19 is identical to the first one.

Figure 4:
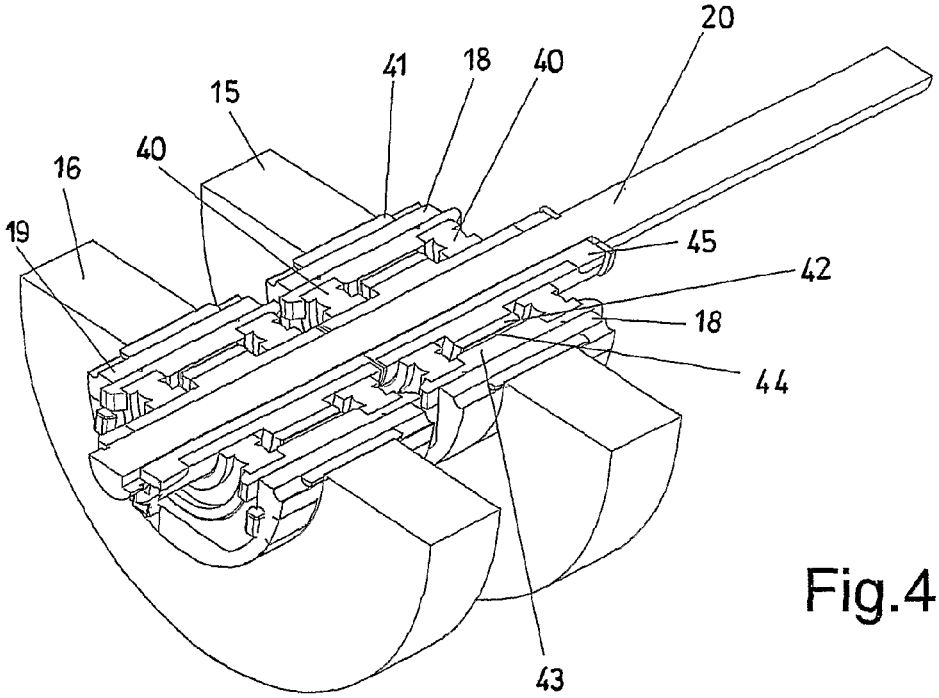
FIG. 4 represents a perspective view of the collection sprockets of the belts in section.

FIG. 4 shows the driving part of the joint 45, fixed to the shaft 20, intended to hold the magnet 42. The size of the magnet 42 can vary according to the needs and to the desired tensions on the belt. The joint also comprises a driven part 43, which is rotatably mounted with respect to the driving part 45 through a pair of bearings 40 arranged on opposite sides of the magnet 42. The bearings 40 are fastened to the driving part 45 and to the driven part 43 through simple interlocking.

The driven part 43 also has a portion 44 made from a material having set polarity characteristics suitable for cooperating with the magnet 42 to make the magnetic joint between the driving part and the driven part.

On the driven part 43, the sprocket 18 is removably fixed through interlocking. It should be understood that other fixing methods are also possible between the sprocket 18 and the driven part 43 of the joint.

On the outer crown of the sprocket 18 there are some pins 41, intended to fix the belt of film 26 to the sprocket 18. There can be two or more pegs.

The axial shifting of the joints with respect to the shaft 20 can advantageously be limited through two Segers or other fastening systems.

Figure 5:
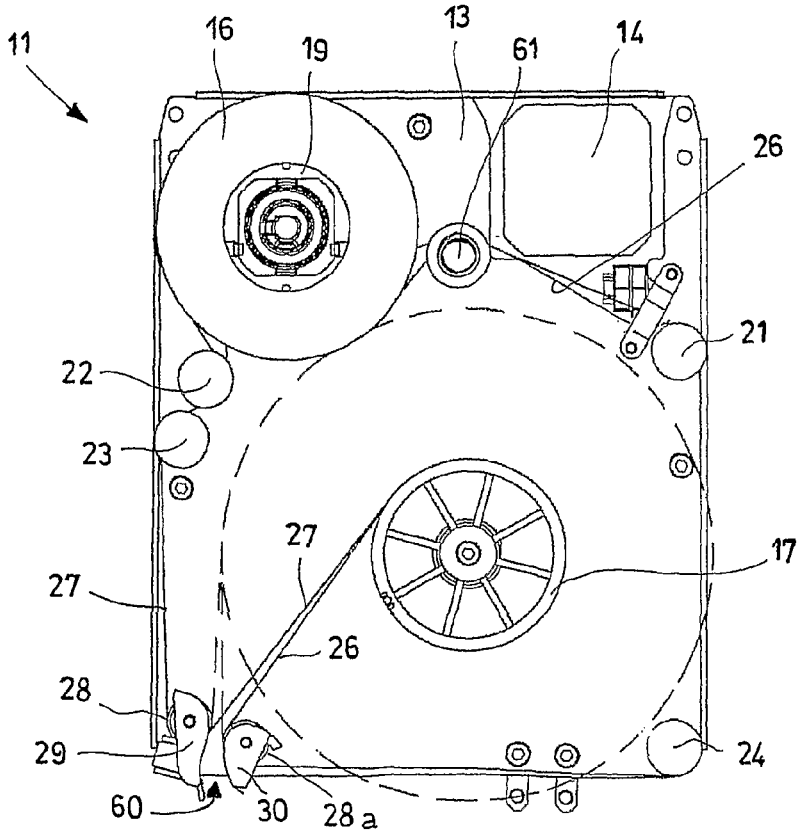
FIG. 5 represents a front view of the store on the side of the sprockets and of the storage roller.

FIG. 5 shows the front view of the store. The dotted line represents the storage roller 17 with an amount of wound banknotes, and the position taken up by the conveyor belts. The continuous line shows the belts 26, 27 when the roller 17 does not have wound banknotes on its side surface.

The store is advantageously controlled by electronic control means, known per se, suitable for controlling the actuation of the motor 14. The store can comprise known sensor means able to constantly monitor the state of the sprockets and of the roller, so as to know the number of stored banknotes on the roller 17.

Hereafter, the operation of the store in different banknote storing and releasing conditions shall be described.

In the storing step, the sprockets 18, 19, seen in FIG. 5, rotate in an anti-clockwise direction and the roller 17 rotates in a clockwise direction. The banknotes enter the store at the entrance/exit 60 and are conveyed by the belts 26, 27 towards the roller 17, where they are wound and stored. The motor 14 commands an anti-clockwise rotation of the pinion 32, as seen in FIG. 3. The pinions 33 and 34 also rotate in an anti-clockwise direction, as seen in FIG. 3, through engagement with the belt 31. The roller 17 rotates as a unit with the pinion 34, whereas the pinion 33 does not transmit motion to the shaft 20, which remains still. The sprockets 18 and 19 rotate conveyed by the respective belts, when the tension of the belt reaches a predetermined threshold related to the maximum torque that can be transmitted by the magnetic joint acting between the shaft 20 and the sprockets 18, 19. In this way, it is ensured that the tension of the belts is always the desired one predetermined in the storage step.

In the banknote releasing step, the sprockets 18, 19, as seen in FIG. 5, rotate in a clockwise direction to wind the respective belt, whereas the roller 17 rotates in an anti-clockwise direction. The banknotes are unwound from the roller 17 and are conveyed by the roller towards the entrance/exit 60 of the store.

The motor 14 induces a clockwise rotation of the pinion 32, as seen in FIG. 3. The pinions 34 and 33 also rotate in a clockwise direction, conveyed by the belt 31. In this case, the pinion 33 transmits the motion to the shaft 20, which rotates as a unit with the pinion. The shaft 20 rotates with a greater rotation speed than the roller 17, thanks to the relative size of the pinion 34 compared to that of the pinion 33. The sprockets 18, 19 are thus braked by the respective belts 26, 27, which travel at the speed induced by the rotation of the roller 17. In this way, the magnetic joints which act between the sprockets 18, 19 and the shaft 20, come into play, allowing shifting between the shaft and sprocket with a set transmitted torque. Also in this operation condition, therefore, the tension of the belt of film 26, 27 is equal to a set tension, related to the properties of the magnetic joints.

At this point it should be clear how the purposes of the present invention have been reached.

In particular a banknote store has been provided having a compact structure and that is not very bulky. The particular positioning of the sprockets for collecting the belts on the same shaft has allowed enough space to be gained to house the motor for actuating the sprockets and the storage roller at the height of the courses of the conveyor belts. This has allowed the thickness of the store in a direction parallel to the axis of the sprockets and of the roller to be substantially reduced.

Moreover, the belts are offset and do not mutually overlap when they are wound on the storage roller. This allows the bulk of the roller to be substantially reduced when the banknotes are wound up on it, increasing the capacity of the store.

Moreover, thanks to the presence of the magnetic joints and to the particular configuration of the motion transmission, it is possible to use a single motor to move the sprockets and the storage roller, ensuring the correct tension on the banknote conveyor belts in every operating condition.

A cost-effective store has thus been provided having a simple structure, made from a limited number of components.

Of course, the description above of an embodiment applying the innovative principles of the present invention is given as an example of such innovative principles and must not therefore be used to limit the scope of protection claimed hereby.

The invention claimed is:

1. A banknote store comprising a banknote storage roller, two banknote conveyor belts and two collection sprockets of said belts, each belt being wound on one side to the storage roller and on the other to one of the collection sprockets, the two belts being arranged to come into contact with the banknotes respectively on opposite faces, handling means being present to move the roller, the sprockets and the belts so as to alternatively realize the storage of the banknotes on the roller or their release from the store, said collection sprockets being mounted on a same shaft, the sprockets being mounted on the respective shaft with the interposition of a joint able to limit the torque transmitted between the shaft and the sprocket.

2. The banknote store according to claim 1, wherein the joint is a magnetic joint.

3. The banknote store according to claim 1, wherein the handling means comprise a single motor and motion transmission means from the motor to the shaft of the sprockets and to the roller.

4. The banknote store according to claim 3, wherein the motion transmission means comprises a free wheel suitable for transmitting motion to the shaft of the sprockets only in the direction of the winding of the belts on the sprockets.

5. The banknote store according to claim 3, wherein the motion transmission means is such as to induce a rotation speed of the shaft of the sprockets greater than that of the storage roller during the unwinding of the belts from the roller.

6. The banknote store according to claim 3, further comprising a frame comprising in turn at least one supporting plate, the sprockets, the roller and the motor being mounted on one same side of the plate, the motion transmission means being arranged on the opposite side of the plate.

7. The banknote store according to claim 3, wherein the motor is arranged at the height of the courses of the banknote conveyor belts.

8. The banknote store according to claim 1, wherein the belts are wound offset and not mutually overlapped on the storage roller.

9. The banknote store according to claim 1, wherein return means of the belts are present between the sprockets and the roller to form a banknote conveying path from an entrance/exit of the store to the roller and vice versa.

10. The banknote store according to claim 1, wherein the shaft on which the sprockets are mounted is rotatable only in the winding direction of the belt on the sprockets.

11. A banknote store comprising a banknote storage roller, two banknote conveyor belts and two collection sprockets of said belts, each belt being wound on one side to the storage roller and on the other to one of the collection sprockets, the two belts being arranged to come into contact with the banknotes respectively on opposite faces, handling means being present to move the roller, the sprockets and the belts so as to alternatively realize the storage of the banknotes on the roller or their release from the store, said collection sprockets being mounted on a same shaft, the handling means including a single motor and motion transmission means from the motor to the shaft of the sprockets and to the roller, and a frame including in turn at least one supporting plate, the sprockets, the roller and the motor being mounted on one same side of the plate, the motion transmission means being arranged on the opposite side of the plate.

12. The banknote store according to claim 11, wherein the motion transmission means comprises a free wheel suitable for transmitting motion to the shaft of the sprockets only in the direction of the winding of the belts on the sprockets.

13. The banknote store according to claim 11, wherein the motion transmission means is such as to induce a rotation speed of the shaft of the sprockets greater than that of the storage roller during the unwinding of the belts from the roller.

* * * * *

UNITED STATES PATENT AND TRADEMARK OFFICE

CERTIFICATE OF CORRECTION

PATENT NO. : 8,408,543 B2
APPLICATION NO. : 13/058057
DATED : April 2, 2013
INVENTOR(S) : Razzaboni et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 98 days.

Signed and Sealed this
First Day of September, 2015

Michelle K. Lee

Michelle K. Lee
*Director of the United States Patent and Trademark Office*